US005201262A

United States Patent [19]

Negishi et al.

[11] Patent Number: 5,201,262

[45] Date of Patent: * Apr. 13, 1993

[54] ACTUATOR USING ELASTIC EXTENSIBLE MEMBER

[75] Inventors: Koichi Negishi, Kodaira; Teruyoshi Sato, Kawasaki, both of Japan

[73] Assignee: Bridgestone Corporation, Tokyo, Japan

[ * ] Notice: The portion of the term of this patent subsequent to Jan. 28, 2009 has been disclaimed.

[21] Appl. No.: 540,550

[22] Filed: Jun. 19, 1990

[30] Foreign Application Priority Data

Jun. 20, 1989 [JP] Japan ..... 1-155643

[51] Int. Cl.[5] ..... F01B 19/04

[52] U.S. Cl. ..... 92/92; 92/165 R

[58] Field of Search ..... 92/92, 132, 61, 165 R

[56] References Cited

U.S. PATENT DOCUMENTS

| | | | |
|---|---|---|---|
| 2,377,170 | 5/1945 | Morgan | 92/92 |
| 2,483,239 | 9/1949 | Sharpe | 92/61 |
| 3,431,824 | 3/1969 | Damm | 92/132 |
| 3,481,254 | 12/1969 | Wetherbee | 92/92 |
| 3,638,536 | 2/1972 | Kleinwachter et al. | 92/92 |
| 3,645,173 | 2/1972 | Yarlott | 92/92 |
| 4,108,050 | 8/1978 | Paynter | 92/132 |
| 4,615,260 | 10/1986 | Takagi et al. | 92/92 |
| 4,721,030 | 1/1988 | Poynter | 92/92 |
| 4,841,845 | 6/1989 | Beullens | 92/92 |
| 4,848,168 | 7/1989 | Negishi | 92/92 |
| 4,860,639 | 8/1989 | Sakasuchi | 92/92 |

*Primary Examiner*—Edward K. Look
*Assistant Examiner*—F. Daniel Lopez
*Attorney, Agent, or Firm*—Sughrue, Mion, Zinn, Macpeak & Seas

[57] ABSTRACT

An actuator includes an elastic member extensible in axial directions when a pressurized fluid is supplied into the elastic member, and guiding device arranged inwardly of the elastic member and permitting the elastic member to move in the axial directions, but restraining the elastic member from moving in directions intersecting the axial directions. As the actuator is of an air-bag type so that energy of the pressurized fluid can be converted into mechanical movement with high efficiency. The actuator moves only in radial directions without expanding in radial directions, so that a space occupied by the actuator in operation is little.

18 Claims, 3 Drawing Sheets

ACTUATOR USING ELASTIC EXTENSIBLE MEMBER

BACKGROUND OF THE INVENTION

This invention relates to an actuator using an elastic extensible member extending in axial directions by supplying and exhausting a pressurized fluid into and from the elastic extensible member.

Electric motors, hydraulic cylinders and the like have been known as actuator. However, an electric motor usually requires a speed reduction mechanism including gear trains to increase weight and space to be occupied by the actuator and often suffers a limitation of operable range. Moreover, due to unavoidable occurrence sparks, use of the actuator in a explosion atmosphere is limited.

In contrast herewith, with hydraulic cylinders including motors and cylinders actuated with oil pressure, in addition to the above problems it is difficult to completely prevent leakage of operating oil so that environmental contamination by the leaked oil could not be avoided. Moreover, the temperature and purity of the operating oil must be finely managed and there are many other problems to be solved in the management of such hydraulic cylinders.

In addition, in order to obtain an actuator having a high power, it will be unavoidably large in size.

SUMMARY OF THE INVENTION

It is an object of the invention to provide an improved actuator which eliminates all the disadvantages of the prior art and is small-sized and light weight and free from environmental contamination and which exhibits high power.

In order to accomplish the object, an actuator using an elastic extensible member according to the invention comprises an elastic member extensible in axial directions when a pressurized fluid is supplied into the elastic member, and guiding means arranged inwardly of the elastic member and permitting the elastic member to move in the axial directions, but restraining the elastic member from moving in directions intersecting the axial directions.

The elastic extensible member is of the so-called airbag type which is able to extend upon being supplied with a pressurized fluid and return to its original size when the pressurized fluid is exhausted therefrom. Therefore, the energy of the pressurized fluid is converted into mechanical movement with high efficiency.

Moreover, the guiding means arranged inwardly of the elastic extensible member serves to restrain the elastic extensible member from moving in direction intersecting the axial directions without obstructing extension and return to its initial dimensions. Therefore, the elastic extensible member does not bend in operation so that the moving directions of the actuator is assured. Consequently, the invention provides an actuator which is small-sized and light weight and exhibits high power output.

The invention will be more fully understood by referring to the following detailed specification and claims taken in connection with the appended drawings.

Figure 1:
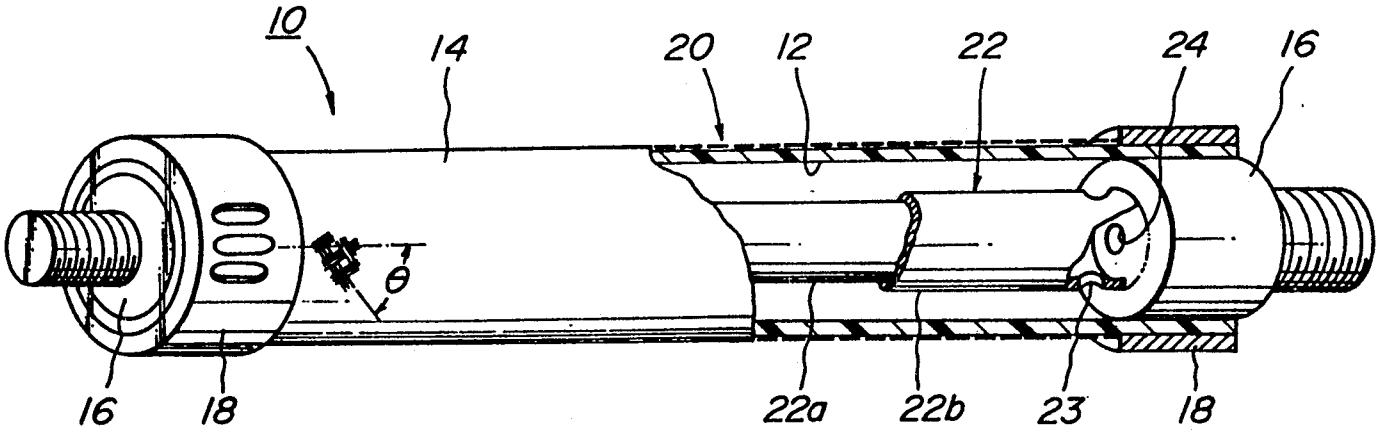
FIG. 1 is a perspective view illustrating the actuator according to the invention in partial section.

FIGS. *2a* and *2b* are explanatory views illustrating the operation of the actuator shown in FIG. 1 and the relationship between the extending force and the extension coefficient;

FIG. *3a* is a perspective view illustrating another embodiment of the actuator according to the invention; and FIG. *3b* is a partial enlarged view of the actuator shown in FIG. *3a*.

DETAILED EXPLANATION OF THE PREFERRED EMBODIMENTS

FIG. 1 illustrates in partial section an actuator 10 using an elastic extensible member according to the invention. A tubular body 12 is surrounded by a reinforcing braided structure 14 and closed at both open ends by closure members 16. In order to securely prevent the tubular body 12 and the reinforcing braided structure 14 from being dislodged, these members are externally pressed by clamp sleeves 18 to form an elastic extensible member 20. Moreover, guiding means is arranged inwardly of the elastic extensible member 20.

The tubular body 12 is preferably made of a rubber or rubber-like elastomer or other materials equivalent thereto, which are impermeable to pressurized fluids such as pressurized air, liquid and the like and superior in flexibility permitting of the tubular body sufficiently expanding when the pressurized fluid is applied. The reinforcing braided structure 14 is reinforced by cords which are organic or inorganic high tensile fibers, for example, polyester fibers or aromatic polyamide fibers (trade name, KEVLAR) or twisted or nontwisted filament bundles such as very fine metal wires. Braided structures may be used whose braided angles change from an initial braided angle $\theta_0$ to a so-called an angle of repose (54°44') at the maximum elongation of the tubular body 12 in the axial direction when applied the pressurized fluid. Moreover, the initial braided angle $\theta_0$ may be selected within angles of the order of 70° to 85°.

At least one of the closure members 16 closing both the ends of the tubular body 12 and the reinforcing braided structure 14 is formed with a connecting aperture 24 for supplying and exhausting a pressurized fluid into and out of an internal space 12*a* of the tubular body 12.

These closure members 16 may be made of a metal. However, they may be preferably made of so-called engineering plastics in order to make the actuator 10 more light weight.

In the embodiment, moreover, each of the closure members 16 is provided on an external end face with a projection extending in its axial direction. The projection is formed with a male screw which is threadedly engaged with a female screw formed in a suitable fixing member or a driven member, thereby enabling the actuator to be integrally fixed to such a member. However, the connection is not limited to such a thread-screw connection, but various modifications can be effected. For example, the projection is formed with a pin-shaped aperture, and a pivot pin secured to a fixing member or driven member is inserted into the pin-shaped aperture for this purpose.

The guiding means 22 consists, for example, of a rod member 22*a* and a cylindrical member 22*b* in which the rod member 22*a* is fitted. Respective ends of the rod member 22*a* and the cylindrical member 22*b* are integrally fixed to the closure members 16. When the pressurized fluid is supplied into and exhausts from the elastic extensible member 10, the rod and cylindrical members 22a and 22b permit the elastic extensible member 10 to move in its axial directions, but restrain the elastic member 10 to move in directions intersecting the axial directions.

In this embodiment, the cylindrical member 22b is fixed to the closure member 16 formed with the connecting aperture 24 and coaxial to the elastic extensible member 20. With this arrangement, the cylindrical member 22b is formed with a communication aperture 23 in proximity to the closure member 16 in order to avoid obstruction of supply and exhaust of the pressurized fluid into and from the internal space 12a of the elastic extensible member 20. The communication aperture 23 additionally serves to render smoother the movement of the rod member 22a in the cylindrical member 22b.

Of course, the arrangement of the connecting aperture 24 and the cylindrical member 22b is not limited to those in this embodiment. For example, the connecting aperture 24 for supplying and exhausting the pressurized fluid into and from the internal space 12a may be provided to open at an outer circumferential surface of the cylindrical member 22b to which the closure member is fixed. Axes of the connecting aperture 24 and the cylindrical member 22b may be arranged to be spaced and in parallel with each other. Moreover, the closure member 16 to which the rod member 22 is fixed may be formed with the connecting aperture 24. Furthermore, the rod member 22a and the cylindrical member 22b is preferably formed by a material having a small friction coefficient such as polytetrafluoroethylene in order to make smooth the relative movement between the rod and cylindrical members 22a and 22b.

As above described, the guiding means 22 is arranged in the internal space 12a of the tubular body 12 constituting the elastic extensible member 20 according to the invention. Therefore, the internal space of the elastic extensible member 20 can be small in comparison with the case having guiding means arranged at any location other than the interior of the elastic extensible member 20 so that the pressurized fluid to be supplied for operating the actuator can be reduced.

Figure 2A:
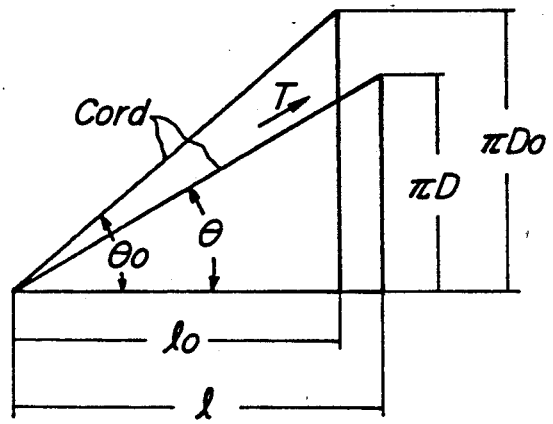
Figure 2B:
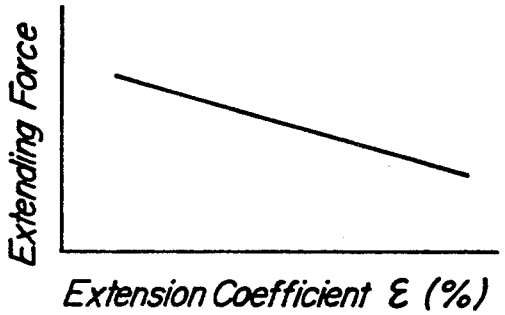

The operation of the actuator 10 according to the invention will be explained referring to FIGS. 2a and 2b. For the sake of clarity, it assumed that lengths of cords constituting the reinforcing braided structure 14 are invariable.

When an initial braided angle of the cords constituting the reinforcing braided structure 14 relative to the axis of the tubular body 12 is $\theta_0$ and the braided angle of the cords after elongated or deformed by applying the pressurized fluid is $\theta$, the following equations are obtained from balance of forces in the axial directions of the tubular body 12 and circumferential directions intersecting the axial directions.

$$nT\cos\theta = \pi/4 \cdot D^2 P + F \quad (1)$$

$$2nT\sin\theta = \pi D^2/\tan\theta \cdot P \quad (2)$$

, where n is the number of the cords, T is tensile force acting upon each cord of the reinforcing braided structure, D is a diameter of the reinforcing braided structure at a center of the cord, P is a pressure of the pressurized fluid applied to the elastic extensible member 20, and F is an extending force caused in the elastic extensible member.

Eliminating T from the equations (1) and (2), an equation (3) is obtained.

$$F = nT\cos\theta - \pi/4 \cdot D^2 P = /4 \cdot D^2 P(1 - 2/\tan^2\theta) \quad (3)$$

It can be understood from the equation (3) that the extensible force becomes zero, when $\theta$ is an angle of repose, that is to say, 54°44'.

On the other hand, consideration of the fact that the lengths of the cords are invariable, $\pi D/\sin\theta = \pi D_0/\sin\theta_0$, which can be changed into an equation (4).

$$D = \sin\theta/\sin\theta_0 \cdot D_0 \quad (4)$$

On the other hand, an extension coefficient $\epsilon$ of the elastic extensible member is obtained by considering of FIG. 2b as follows.

$$\epsilon = (l - l_0)/l_0 = (\cos\theta - \cos\theta_0)/\cos\theta_0$$

and $$\cos\theta = (l + r)\cos\theta_0 \quad (5)$$

In this case, the extending force F is obtained by substituting the equations (4) and (5) into (3).

$$F = \pi/4 \cdot D_0^2 P \cdot K \quad (6)$$

where $K = 1/\sin^2\theta_0 \cdot (1 - 3(1+\epsilon)^2\cos^2\theta_0)$

On the other hand, as $\pi/4 \cdot D_0^2 P$ is equivalent to the output of the cylinder having the effective diameter $D_0$, it is understood that the extending force F of the elastic extensible member 20 is substantially K times the output of the cylinder having the effective diameter $D_0$.

Therefore, for example, where the initial braided angle $\theta_0$ is 80°, when the extension coefficient $\epsilon$ of the elastic extensible member is zero (%), $K \simeq 0.94$. If $\epsilon = 20\%$, $K = 0.90$. If $\epsilon = 50\%$, $K \simeq 0.82$. Relations between the extension coefficient $\epsilon$ and the extending force F are shown in FIG. 2b.

Moreover, it is assumed that the initial braided angle $\theta_0$ of cords of the reinforcing braided structure is 80° and in applying pressurized fluid the cords have been deformed to the angle of repose (54°44'). The extension coefficient $\epsilon$ in this case is 2.32 from the equation (5). Therefore, it is clear that the elastic extensible member is extensible to a great extent.

On the other hand, even if such a great extension is effected, the diameter D of the elastic extensible member after deformed is indicated as follows.

$$D = \sin(54°44')/\sin(80°) \cdot D_0 \simeq 0.83D$$

Therefore, it is understood that the elastic extensible member hardly deforms in radial directions in comparison with its axial movements. In other words, the actuator according to the invention does not expand in radial directions with exception of the axial movements. Accordingly, the actuator needs no space for accommodating expansion in radial directions as air-bag type actuators of the prior art.

Figure 3A:
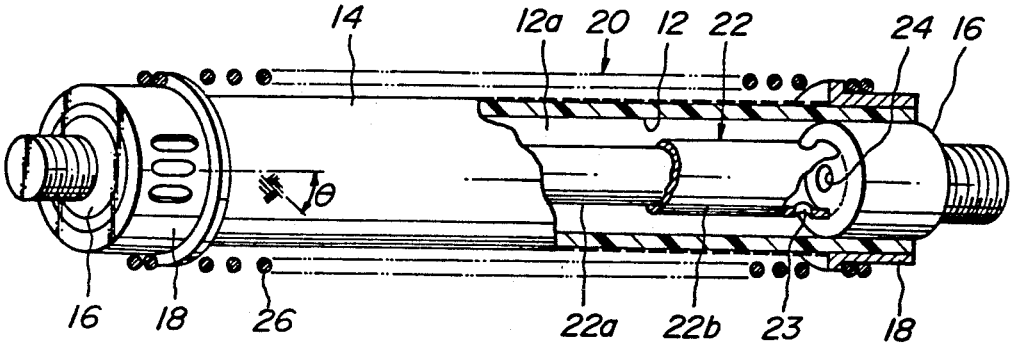

FIG. 3a illustrates another embodiment of the actuator according to the invention. In this embodiment, an elastic member is provided outwardly of the elastic extensible member 20, in order to accomplish quicker returning of the elastic extensible member 20 to its original dimensions when the pressurized fluid is exhausted from an internal space 12a of the elastic extensible member 20. According to the embodiment, the clamp sleeves 18 located a both the ends of the elastic extensible member 20 are formed at opposed ends with flanges, with which are engaged ends of a tension spring 26 as the elastic member.

Of course, the mounting of the elastic member is not limited to this embodiment. For example, the clamp sleeves may be directly formed in their outer circumferential surfaces with spiral grooves without forming the above flanges, and the ends of the tension spring may be coiled in the spiral grooves.

Figure 3B:
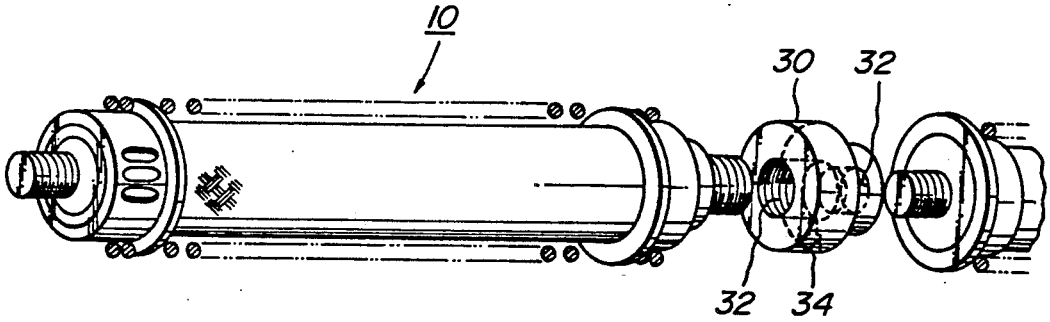

In this embodiment, moreover, the closure member 16 is formed in its projection with a male screw which is threadedly engaged in a female screw formed in a connecting bracket 30 as shown in FIG. 3*b*. A series of actuators are consecutively connected by means of such connecting brackets 30.

In this case, the connecting bracket is preferably formed with the female screws on opposite ends so that a plurality of actuators are easily connected. Moreover, the connecting bracket is further formed with a connecting aperture opening at both the female screws 32 so that the pressurized fluid is supplied into or exhaust from two associated actuators 10 simultaneously.

Individual single connecting brackets 30 may of course be formed with connecting apertures associated with respective actuators, in order to enable the respective actuators to be supplied with the pressurized fluid. Moreover, by suitably selecting the shape of the connecting brackets, three or more actuators can be connected.

On the other hand, moreover, although a plurality of actuators are connected in series in the embodiment, they may be connected in parallel to obtain a high power actuator unit.

The invention is not limited to the above embodiments and various changes and modifications may be made in the invention without departing from the spirit and scope thereof. For example, position detecting means such as linear encoders, differential transformers or the like are arranged in connection with the telescopical cylinder members so that displacement of the actuator can be detected.

As can be seen from the above explanation, the actuator according to the invention is of the air-bag type so that the energy of the pressurized fluid can be converted into mechanical movement with high efficiency. Moreover, the invention can provide an actuator which is small-sized and light weight in comparison with actuators of the prior art and operates without any risk of environmental contamination. Moreover, the actuator according to the invention moves only in axial directions without expanding in radial directions, so that a space occupied by the actuator in operation is little.

If the pressure of the pressurized fluid is kept constant, control of force for the actuator can be effected because of the extending force and the extension coefficient being in a proportional relationship.

What is claimed is:

1. An actuator comprising:

an elongate and flexible elastic member including a tubular body having an axial direction, and a reinforcing structure surrounding the tubular body, said elastic member being extensible in said axial direction as a pressurized fluid is introduced into the tubular body; and guide means arranged within the elastic member for permitting an axial extension of the elastic member while simultaneously restraining the elastic member from moving in directions intersecting the axial direction of the elastic member;

said reinforcing structure having a braided structure with an initial braided angle which is within a range of 70° to 85°.

2. An actuator as set forth in claim 1, wherein said elastic member comprises closure members closing both open ends of the tubular body, and clamp sleeves for tightly connecting the respective closure members to the tubular body and the reinforcing member.

3. An actuator as set forth in claim 2, wherein said guide means comprises a rod member and a cylindrical member slidably fitted with each other, whose outer ends are connected to the elastic member through said closure members, respectively.

4. An actuator as set forth in claim 3, wherein said elastic member includes closure members closing both open ends of the elastic member, one of the closure members being formed with a connecting aperture, and said cylindrical member is formed with a communication aperture.

5. An actuator as set forth in claim 1, wherein said elastic member is provided with elastic means whose ends are connected to ends of the elastic member, respectively, for quickly returning the elastic member to its original dimensions when the pressurized fluid is exhausted from the elastic member.

6. An actuator as set forth in claim 5, wherein said elastic means is a tension spring whose ends are secured to clamp sleeves located at both ends of the elastic member.

7. An actuator as set forth in claim 1, wherein said elastic member comprises a connecting bracket threadedly connecting two actuators.

8. An actuator as set forth in claim 7, wherein said connecting bracket is formed with female screws on opposite ends for connecting a second actuator.

9. An actuator as set forth in claim 8, wherein said connecting bracket is formed with a connecting aperture opening at both the female screws for supplying or exhausting the pressurized fluid into or from two associated actuators.

10. An actuator comprising:

an elongate and flexible elastic member including a tubular body having an axial direction, and a reinforcing structure surrounding the tubular body, said elastic member being extensible in said axial direction as a pressurized fluid is exhausted from the tubular body; and guide means arranged within the elastic member for permitting an axial extension of the elastic member while simultaneously restraining the elastic member from moving in directions intersecting the axial direction of the elastic member;

said reinforcing structure having a braided structure with an initial braided angle which is greater than an angle of repose, 54°44'.

11. An actuator as set forth in claim 10, wherein said elastic member comprises closure members closing both open ends of the tubular body, and clamp sleeves for tightly connecting the respective closure members to the tubular body and the reinforcing braided structure.

12. An actuator as set forth in claim 10, wherein said guide means comprises a rod member and a cylindrical member slidably fitted with each other, whose outward ends are connected to the elastic member through closure members, respectively.

13. An actuator as set forth in claim 12, wherein said closure members close both open ends of the elastic member, one of the closure members being formed with a connecting aperture, and said cylindrical member is formed with a communication aperture.

14. An actuator as set forth in claim 10, wherein said elastic member is provided with elastic means whose ends connected to ends of the elastic member, respectively, for quickly returning the elastic member to its original dimensions when the pressurized fluid is exhausted form the elastic member.

15. An actuator as set forth in claim 14, wherein said elastic means is a tension spring whose ends are secured to clamp sleeves located at both ends of the elastic member.

16. An actuator as set forth in claim 10, wherein said elastic member comprises a connecting bracket threadably connecting two actuators.

17. An actuator as set forth in claim 16, wherein said connecting bracket is formed with female screws on opposite ends.

18. An actuator as set forth in claim 17, wherein said connecting bracket is formed with a connecting aperture opening at both the female screws for supplying or exhausting the pressurized fluid into or from two associated actuators.

* * * * *